US009593838B2

(12) United States Patent
Van Es et al.

(10) Patent No.: US 9,593,838 B2
(45) Date of Patent: Mar. 14, 2017

(54) LIGHTING DEVICE COMPRISING A HEAT SINK STRUCTURE

(71) Applicant: PHILIPS LIGHTING HOLDING B.V., Eindhoven (NL)

(72) Inventors: Arthur Robert Van Es, Eindhoven (NL); Peter Johannes Martinus Bukkems, Deurne (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/419,321

(22) PCT Filed: Aug. 7, 2013

(86) PCT No.: PCT/IB2013/056461

§ 371 (c)(1),
(2) Date: Feb. 3, 2015

(87) PCT Pub. No.: WO2014/024147

PCT Pub. Date: Feb. 13, 2014

(65) Prior Publication Data

US 2015/0192287 A1 Jul. 9, 2015

Related U.S. Application Data

(60) Provisional application No. 61/680,324, filed on Aug. 7, 2012.

(51) Int. Cl.
*F21V 19/00* (2006.01)
*F21V 29/70* (2015.01)
(Continued)

(52) U.S. Cl.
CPC ..... *F21V 29/70* (2015.01); *F21K 9/232* (2016.08); *F21K 9/90* (2013.01); *F21V 7/04* (2013.01);
(Continued)

(58) Field of Classification Search
CPC ..... F21K 9/13; F21K 9/135; F21K 9/1355; F21K 9/30; F21V 19/003; F21V 19/0015; F21V 29/507; F21V 17/107
See application file for complete search history.

(56) References Cited

U.S. PATENT DOCUMENTS 7,344,296 B2 * 3/2008 Matsui ..... F21K 9/00 362/249.01
7,810,953 B2 * 10/2010 Hsu ..... F21S 6/003 362/218
(Continued)

FOREIGN PATENT DOCUMENTS

| | | | |
|---|---|---|---|
| WO | 2010136985 | A1 | 12/2010 |
| WO | 2011078507 | A2 | 6/2011 |
| WO | 2012095583 | A2 | 7/2012 |
| WO | 2012098476 | A1 | 7/2012 |
| WO | 2012099251 | A1 | 7/2012 |

*Primary Examiner* — Julie Bannan

(57) ABSTRACT

A lighting device (1) is provided comprising a light source (5), an electronic carrier (20) comprising a first portion (21) for carrying the light source and a second portion (22) for providing an electrical connection to the light source, and a heat sink structure (10) arranged for a dissipation of heat from the electronic carrier. The heat sink structure comprises at least one lid portion (11, 12) arranged at an opening (14) of the heat sink structure, wherein the opening is at least partially closed by the at least one lid portion. Further, the first portion of the electronic carrier is supported by at least one of the at least one lid portion, and the second portion of the electronic carrier is at least partially enclosed by the heat sink structure. The invention hereby provides improved heat dissipation and a facilitated manufacturing of the lighting device.

17 Claims, 3 Drawing Sheets

(51) Int. Cl.

| | |
|---|---|
| ***F21K 99/00*** | (2016.01) |
| ***F21V 29/507*** | (2015.01) |
| ***F21V 29/89*** | (2015.01) |
| ***F21V 7/04*** | (2006.01) |
| *F21V 29/00* | (2015.01) |
| *F21V 7/22* | (2006.01) |
| *F21Y 101/00* | (2016.01) |

(52) U.S. Cl.

CPC ..... *F21V 19/003* (2013.01); *F21V 19/0015* (2013.01); *F21V 29/507* (2015.01); *F21V 29/89* (2015.01); *F21K 9/23* (2016.08); *F21V 7/22* (2013.01); *F21V 29/004* (2013.01); *F21Y 2101/00* (2013.01); *Y10T 29/4913* (2015.01)

(56) References Cited

U.S. PATENT DOCUMENTS

| | | | | |
|---|---|---|---|---|
| 2003/0189829 | A1* | 10/2003 | Shimizu | F21K 9/13 362/240 |
| 2008/0002399 | A1* | 1/2008 | Villard | F21S 8/086 362/184 |
| 2011/0063842 | A1* | 3/2011 | Takei | F21V 19/004 362/249.01 |
| 2011/0133652 | A1 | 6/2011 | Chen | |
| 2012/0057371 | A1 | 3/2012 | Kai et al. | |
| 2012/0069545 | A1* | 3/2012 | Choi | F21K 9/135 362/84 |
| 2012/0195043 | A1 | 8/2012 | Watanabe et al. | |
| 2013/0301277 | A1* | 11/2013 | Van De Moesdijk | F21V 29/004 362/294 |

* cited by examiner

LIGHTING DEVICE COMPRISING A HEAT SINK STRUCTURE

CROSS-REFERENCE TO PRIOR APPLICATIONS

This application is the U.S. National Phase application under 35 U.S.C. §371 of International Application No. PCT/IB13/056461, filed on Aug. 7, 2013, which claims the benefit of U.S. Provisional Patent Application No. 61/680,324, filed on Aug. 7, 2012. These applications are hereby incorporated by reference herein.

FIELD OF THE INVENTION

The present invention generally relates to the field of lighting devices having a heat sink structure for a dissipation of heat from an electronic carrier of the lighting device. The present invention also relates to methods of manufacturing such lighting devices.

BACKGROUND OF THE INVENTION

Lighting devices comprising solid state light sources, such as light emitting diodes (LEDs), are known in the art. Lighting devices comprising LEDs may be used for a general lighting or even for a more specific lighting, as the color and the output power of the LEDs may be tuned. Generally, the light source(s) of the lighting devices is (are) mounted on, or at least connected to, a circuit board. The light source(s) may be arranged within an encapsulating housing, usually having the shape of a bulb. In addition to provide a maximum output of light and/or a specific color of light, the design of a lighting device needs to take into account the evacuation of heat generated by the light source(s) and/or the electronics connected to the light source(s).

In WO 2010/136985, a LED-based illumination device is disclosed comprising a light source, a carrier for supporting the light source, and an envelope. The carrier, shaped as a disc, is arranged within the envelope, wherein the edge of the carrier is in contact with the envelope along an inner circumference of the envelope. By this arrangement, the carrier divides an inner space of the envelope into two parts. For a transfer of heat generated within the LED-based illumination device during operation, the carrier is arranged in thermal contact with the envelope along the entire axial extent of the envelope.

However, alternative solutions for a heat dissipation of lighting devices may be of interest. Furthermore, it is also desirable to facilitate manufacturing of such lighting devices.

SUMMARY OF THE INVENTION

The present invention has been made with respect to the above considerations. It is an object of the present invention to provide a lighting device with improved heat dissipation from its heat generating components in order to extend the LED lifetime, and/or to increase the light output or to reduce number of LEDs for a certain light output. It is also an object of the present invention to provide a facilitated method of manufacturing such a lighting device.

According to the present invention, these and other objects are achieved by means of a lighting device and a method of manufacturing a lighting device as defined by the independent claims. Preferred embodiments are defined in the dependent claims.

Hence, according to a first aspect of the invention, a lighting device is provided. The lighting device comprises a light source, an electronic carrier comprising a first portion for carrying the light source and a second portion for providing an electrical connection to the light source, and a heat sink structure arranged for a dissipation of heat from the electronic carrier. The heat sink structure comprises at least one lid portion arranged at an opening of the heat sink structure, wherein the opening is at least partially closed by the at least one lid portion. Further, the first portion of the electronic carrier is supported by at least one of the at least one lid portion, and the second portion of the electronic carrier is at least partially enclosed by the heat sink structure.

According to a second aspect of the present invention, a method of manufacturing a lighting device is provided. The method comprises providing a heat sink structure comprising a first lid portion and a second lid portion arranged at an opening of the heat sink structure, and folding the first lid portion such that it partially closes the opening. Further, an electronic carrier comprising a first portion for carrying a light source and a second portion for providing an electrical connection to the light source is arranged such that the first portion of the electronic carrier is supported by the first lid portion and the second portion of the electronic carrier is at least partially enclosed by the heat sink structure. Further, the second lid portion is folded such that it together with the first lid portion at least partially closes the opening of the heat sink structure.

The heat sink structure of the lighting device according to the present invention provides an improved heat dissipation compared to arrangements in the prior art. During operation of the lighting device, heat is dissipated from the first portion of the electronic carrier (and thereby also from the light source), since the first portion of the electronic carrier is supported by at least one of the lid portions of the heat sink structure. An improved thermal path is provided from the lid portions (or flaps) to the portion of the heat sink structure at least partially enclosing the second portion of the electronic carrier (or driver), as the lid portions and the portion of the heat sink structure, at least partially enclosing the second portion of the electronic carrier, are comprised in a common heat sink structure. Furthermore, during operation of the lighting device, heat is dissipated from the second portion of the electronic carrier to the heat sink structure, since the heat sink structure at least partially encloses the second portion of the electronic carrier, and thereby further provides a thermal path between the second portion and the heat sink structure. It will further be appreciated that the heat sink structure of the present invention provides a large cooling surface, which even further increases the efficiency of the heat dissipation properties of the lighting device.

As the light source typically generates relatively much heat (compared to the portion of the electronic carrier that provides for an electrical connection to the light source), the demands on heat dissipation from the light source and its associated electronic carrier portion are high. The present invention meets these heat dissipation demands, and provides an improved heat dissipation compared to arrangements in the prior art.

Furthermore, as the present invention provides a common heat structure (or heat sink component) comprising the at least one lid portion and the portion of the heat sink structure at least partially enclosing the second portion of the electronic carrier, the number of components of the lighting device is reduced. Hence, the present invention is further advantageous in that the manufacturing of the lighting device becomes more efficient due to a facilitated assembly of the lighting device. Furthermore, the common heat sink structure of the present invention provides an inexpensive manufacturing of the lighting device.

The second portion of the electronic carrier may comprise tracks or other suitable means for providing an electrical connection to the light sources. For example, current and/or voltage is supplied by driver electronics via the electrical connection to the light sources. Alternatively the second portion may also comprise driver electronics.

According to an embodiment of the present invention, at least one of the at least one lid portion is folded such that the opening is at least partially closed by the at least one lid portion. The present embodiment is advantageous in that the opening of the heat sink structure is thereby easily and conveniently closed by the at least one lid portion (lid portions), which even further contributes to a facilitated assembly of the lighting device.

According to an embodiment of the present invention, the heat sink structure and the at least one lid portion may be formed by a single piece of material. The present embodiment is advantageous in that the manufacturing of the lighting device is even further facilitated, as the number of components in the lighting device is even further reduced. Consequently, the lid portions do not have to be mounted to the opening of the heat sink structure during the assembly of the lighting device, as they are already connected to the heat sink structure. Further, as the heat sink structure and the at least one lid portion may be formed by a single piece of material, the thermal path between the lid portions and the remaining portion of the heat sink structure is improved, thereby further improving the heat dissipation from the lid portions and the first portion of the electronic carrier.

According to an embodiment the heat sink structure and the at least one lid portion may comprise sheet metal. Further, the method of manufacturing the lighting device may comprise providing the heat sink structure by deep drawing a piece of sheet metal. The present embodiment is advantageous in that sheet metal has a high thermal conductivity, thereby even further improving the heat dissipation from the electronic carrier. Further, the sheet metal allows deep drawing for forming the (desired) shape of the heat sink structure. However, other methods of forming the heat sink structure are also envisaged, such as rolling or stamping the sheet metal. Alternatively, the heat sink structure may be casted.

According to an embodiment of the present invention, the lighting device may comprise at least two lid portions, and a second lid portion may be arranged to clamp the first portion of the electronic carrier to a first lid portion. By the term "clamp", it is here meant a clamping, holding, pressing and/or pinching of the first portion of the electronic carrier to the second lid portion. Hence, the second lid portion holds the first portion of the electronic carrier in place at the first lid portion. The present embodiment is advantageous in that the mechanical clamping of the electronic carrier to the first lid portion is easily performed and/or that no adhesive is required to attach the first portion of the electronic carrier to the first lid portion, which further facilitates manufacturing as well as recycling of the lighting device. Furthermore, as the second lid portion may press the first portion of the electronic carrier towards the first lid portion, the heat dissipation from the first portion of the electronic carrier to the heat sink structure becomes even further improved.

According to an embodiment of the present invention, the lighting device may comprise at least two lid portions, and wherein the lid portions at least partially overlap each other, which increases the thermal (and physical) contact surface between the lid portions. Further, as the material thickness is increased in the region of the overlapped lid portions, the heat dissipation from the first portion of the electronic carrier is even further improved.

According to an embodiment of the present invention, at least one of the at least one lid portion may be fixed in a folded position by a locking means. The locking means may thus hold the at least one lid portion in the folded position, and preferably in abutment (or physical contact) to the opening of the heat sink structure, which further improves the heat dissipation from the lid portions to the remaining portion of the heat sink structure.

According to an embodiment of the present invention, the at least one lid portion may be arranged to define a hole (or recess), and wherein the electronic carrier is arranged to extend through the hole. For example, a lid portion may comprise a recess in the edge to be mated with another lid portion, such that the opening of the heat sink structure, closed by the at least one lid portion, comprises a recess. If the at least one lid portion is folded, the recess may define a hole between the lid portions when they are in a folded position. Preferably, the size of the hole corresponds to the size of the portion of the electronic carrier located in the hole, so as to provide a close fit of the electronic carrier in the hole, thereby even further improving the heat dissipation of the lighting device.

According to an embodiment of the present invention, the first portion of the electronic carrier may be supported by at least one of the at least one lid portion outside a cavity defined by the heat sink structure, and the second portion of the electronic carrier may be arranged inside the cavity. Hence, the cavity of the heat sink structure at least partially encloses the second portion of the electronic carrier. For example, the portion of the heat sink structure defining the cavity may be substantially cup-shaped with two opposite openings, wherein one is closed by the at least one lid portion and the other is arranged for allowing an electrical connection between the second portion of the electronic carrier and a power supply contact of the lighting device (such as a screw base).

According to an embodiment of the present invention, the lighting device may further comprise a housing at least partially enclosing the heat sink structure. The present embodiment is advantageous in that the housing protects the heat sink structure from outer damage. Furthermore, the housing may be in thermal contact with the heat sink structure, such that the housing may dissipate heat from the heat sink structure to the surroundings.

According to an embodiment of the present invention, the outer shape of the heat sink structure may be at least partially conformed to the inner shape of the housing. Hence, the outer shape of the heat sink structure may be arranged to closely fit in the housing. The present embodiment is advantageous in that the (close) fit of the heat sink and the structure even further improves the heat dissipation from the heat sink structure to the housing. Further, a mounting of the heat sink structure in the housing is facilitated, as the heat sink structure easier arranges in the intended position in the housing. Preferably, a major part of the outer shape of the heat sink structure may be conformed to the inner shape of the housing, thereby further improving the close fit of the heat sink in the housing, and consequently, also improving the heat dissipation.

According to an embodiment of the present invention, the housing may comprise an electrically insulating material, such as ceramics or plastics. Hence, the present embodiment is advantageous in that the housing electrically insulates the heat sink and the electronic carrier from the surroundings. Preferably, the electrically insulating material may be adapted for dissipating heat from the heat sink structure, and may therefore preferably have a rather high thermal conductivity.

According to an embodiment of the present invention, the first portion of the electronic carrier may make an angle of 40° to 140°, preferably 60° to 120°, and most preferably 80° to 100°, with the second portion of the electronic carrier. Hence, the first portion may be supported by at least one of the at least one lid portion in a substantially horizontal position, while the second portion of the electronic carrier may extend downwards in (the cavity of) the heat sink structure in a substantially vertical direction. Preferably, the first and second portions of the electronic carrier may be rigidly connected to each other. For example, the first and second portions of the electronic carrier may be part of a single piece printed circuit board (PCB) being folded between the first and second portions to form the above described angle. It will be appreciated that the first and second portions of the electronic carrier remain electrically connected in the case at least one lid portion is folded.

According to an embodiment of the present invention, at least one of the at least one lid portion may comprise a reflective surface adapted to reflect light from the light source. The present embodiment is advantageous in that the light output from the lighting device is increased.

It is noted that the invention relates to all possible combinations of features recited in the claims. Further, it will be appreciated that the various embodiments described for the lighting device are all combinable with the method as defined in accordance with the second aspect of the present invention.

Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

This and other aspects of the present invention will now be described in more detail, with reference to the appended drawings showing embodiments of the invention.

All the figures are schematic, not necessarily to scale, and generally only show parts which are necessary in order to elucidate the invention, wherein other parts may be omitted or merely suggested.

DETAILED DESCRIPTION

Figure 1:
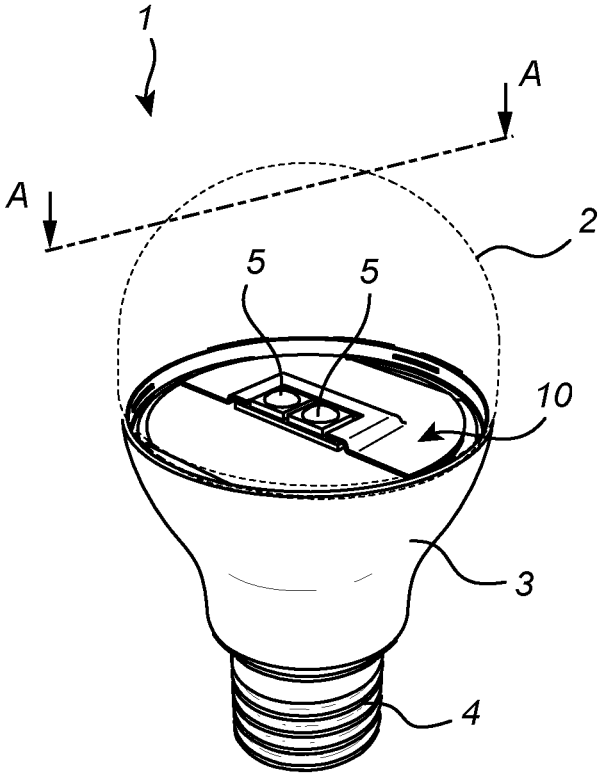
FIG. 1 shows a lighting device according to an embodiment of the present invention.
Figure 2:
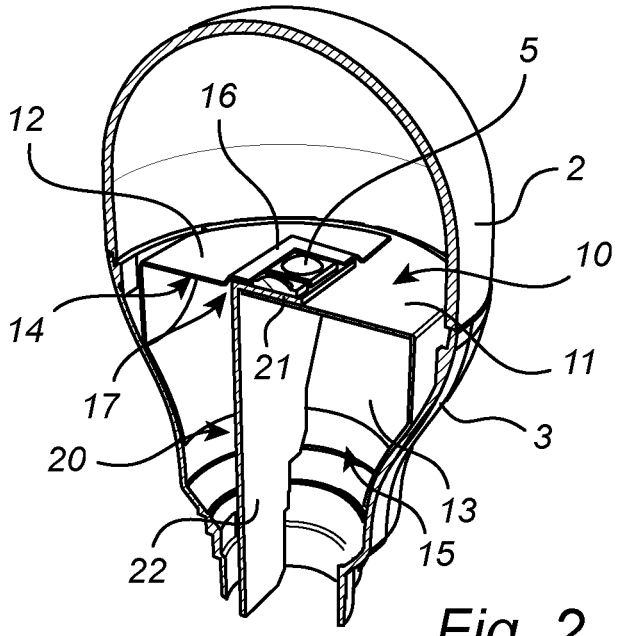
FIG. 2 is a cross section of the lighting device shown in FIG. 1.

With reference to FIGS. 1 and 2, a lighting device according to an embodiment of the present invention will be described. FIG. 2 is a cross section taken along line A-A in FIG. 1.

The lighting device 1 in FIGS. 1 and 2 comprises an envelope (or bulb) 2, a housing 3, and a screw base 4, together enclosing the interior of the lighting device 1. The lighting device 1 further comprises one or more light sources 5 and a heat sink structure 10. The light sources 5 are arranged at a first portion 21 of an electronic carrier 20, such as a printed circuit board (PCB). The electronic carrier 20 further comprises a second portion 22 comprising at least an electrical connection to electronics for driving the light sources 5. Optionally the second portion 22 also comprises the electronics for driving the light sources 5. The first portion 21 of the electronic carrier 20 may hereinafter be referred to as the light source portion 21 and the second portion 22 of the electronic carrier 20 as the driver portion 22.

The heat sink structure 10 is adapted to dissipate heat from the light sources 5 and/or the electronic carrier 20, e.g. via the housing 3, to the surroundings of the lighting device 1, wherein a dissipation of heat from the light sources 5 and/or the electronic carrier 20 extends the life time of the lighting device 1. The heat sink structure 10 defines a cavity 13, in which the driver portion 22 of the electronic carrier 20 is arranged, and the heat sink structure 10 further comprises an opening 14 towards the envelope 2. A first lid portion 11 and a second lid portion 12 are arranged at the opening 14, wherein the lid portions 11, 12 close the opening 14 or are folded so as to close the opening 14. In other words, the lid portions 11, 12 may be folded to form a lid over the cavity 13 of the heat sink structure 10. The heat sink structure 10 further comprises an additional opening 15, opposite to the opening 14 with the lid portions 11, 12, through which additional opening 15 the driver portion 22 (or an electrical connection to the driver portion 22) may extend for connecting the driver portion 22 to the screw base 4. The outer shape of the portion of the heat sink structure 10 enclosing the driver portion 22 may preferably at least partly follow the shape of the inner walls of the housing 3, thereby providing a close fit between the heat sink structure 10 and the housing which improves the thermal (and physical) contact there between. In the present example, the housing 3 is cup-shaped, and the heat sink structure 10 therefore has a corresponding cup-shape.

The heat sink structure 10 may extend from a base portion of the lighting device (e.g. in a vicinity of the screw base 4) to an approximate center portion of the lighting device 1, as shown in FIGS. 1 and 2. As the lid portions 11, 12 provide a horizontal definition within the lighting device 1, the envelope 2 and the heat sink structure 10 defines a single compartment above the lid portions 11, 12 at least partially enclosing the light sources 5. It will be appreciated that the single compartment may be free from further elements and/or components, which in turn prevents an optical obstruction for the light emitted by the light sources 5 during operation. Hence, the lighting device 1 of the present invention provides a homogeneous, substantially omnidirectional light distribution from the light sources 5.

The lid portions 11, 12 may be arranged (or folded) so as to abut an edge of the opening 14 (i.e. to abut the portion of the heat sink structure 10 enclosing the driver portion 22 of the electronic carrier 20). For a fixation of the lid portions 11, 12 in a folded position, the lighting device 1 may comprise locking means (not shown). The locking means may e.g. comprise one or more (small) protrusion(s) on the inside of the housing 3, located closely above the heat sink structure 10. This arrangement allows a snap fitting of the lid portions 11, 12, such that the protrusion(s) hold(s) the lid portions 11, 12 in the folded position. Alternatively, or as a complement, the locking means may be formed by features in one or more of the lid portions 11, 12, such as a protrusion in one of the lid portions 11, 12 arranged to be mated with a recess in the other lid portion 11, 12. Other locking means may also be envisaged.

The lid portions 11, 12 (e.g. after folding the lid portions 11, 12 into the folded position (state)) define a hole (or recess) 17 in the heat sink structure 10, through which hole 17 the electronic carrier 20 extends through, such that the light source portion 21 is supported by the first lid portion 11 and the driver portion 22 is at least partially enclosed by the heat sink structure 10 in the cavity 13. Further, the light source portion 21 of the electronic carrier 20 preferably makes an angle with the driver portion 22 of 40° to 140°, preferably 60° to 120°, and most preferably 80° to 100°, such as around 90°, whereby the light source portion 21 is supported by the first lid portion 11 in a substantially horizontal plane and the driver portion 22 extends downwards in the cavity 13 in a substantially vertical plane. Accordingly, the lid portions 11, 12 enable having a single electronic carrier 20 for both carrying and driving the light sources 5, whereby a heat sink portion (i.e. the first lid portion 11) supports and cools the light source portion 21 of the electronic carrier 20.

Preferably, the second lid portion 12 may partially overlap the first lid portion 11 and preferably also clamp the light source portion 21 to the first lid portion 11. The second lid portion 12 may e.g. comprise an edge 16 arranged to overlap a portion of the light source portion 21, thereby forcing the light source portion 21 towards the first lid portion 11. The overlapping of the edge 16 and the light source portion 21 increases the thermal contact surface between the electronic carrier 20 and the heat sink structure 10, and thereby leads to an even more efficient heat dissipation.

During operation of the lighting device 1, the driving electronics and, in particular, the light sources 5, generate heat. Heat from the light sources 5 is conducted via the light source portion 21 of the electronic carrier 20 through the lid portions 11, 12 towards the periphery of the opening 14 of the heat sink structure 10, and then down through the portion of the heat sink structure 10 partially enclosing the driving portion 22, and finally, via the housing 3, out of the lighting device 1 to the surroundings.

With reference to FIGS. 3 to 7, a method of manufacturing the lighting device 1 according to an embodiment of the present invention will be described.

Figure 3:
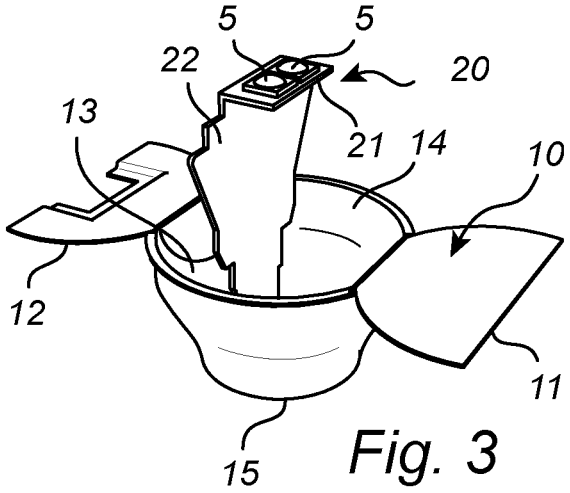
FIGS. 3-7 show a method of manufacturing a lighting device according to an embodiment of the present invention.

The method may comprise the steps of providing the heat sink structure 10 having the lid portions 11, 12 and providing the electronic carrier 20, as shown in FIG. 3. The heat sink structure 10 may preferably be formed by deep drawing a piece of sheet metal into a cup-like shape for forming the portion of the heat sink structure 10 for accommodating the driver portion 22 of the electronic carrier 20. The same piece of sheet metal may also comprise the first and second lid portions 11, 12 arranged at an edge of the opening 14 of the heat sink structure 10.

Figure 4:
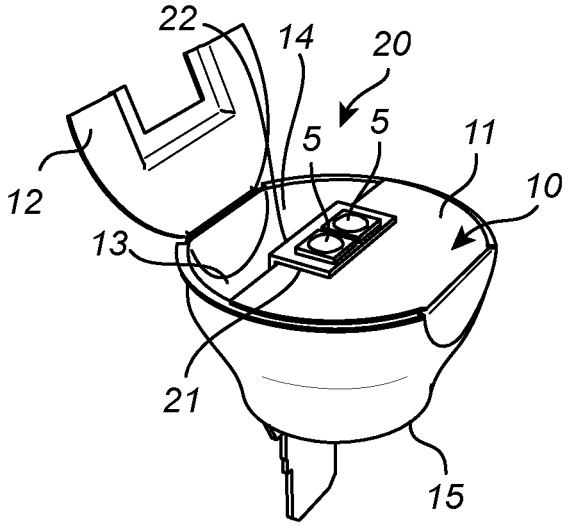

The method further comprise the steps of folding the first lid portion 11, such that it abuts the edge of, and partially close, the opening 14 of the heat sink structure 10, and subsequently arranging the light source portion 21 of the electronic carrier 20 at the first lid portion 11, as shown in FIG. 4. The light source portion 21 is now supported by the first lid portion 11 and the driver portion 22 extends downwards in the cavity 13 of the cup-shaped heat sink structure 10.

Figure 5:
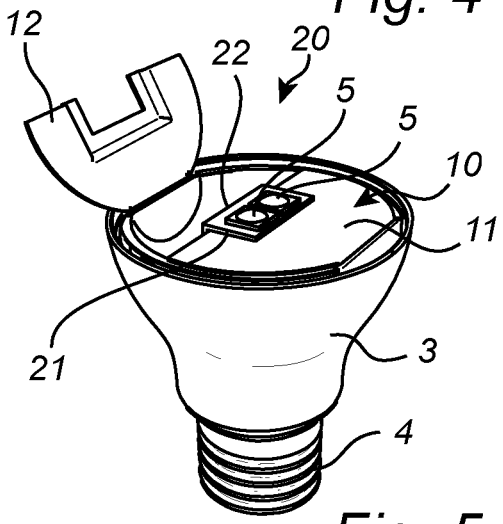
Figure 6:
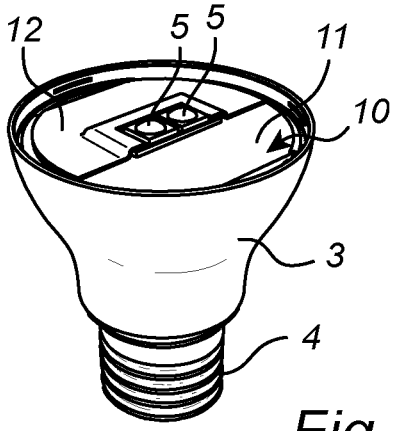
Figure 7:
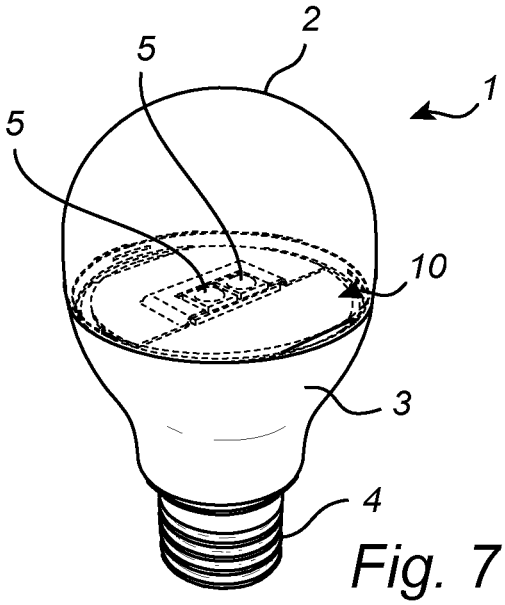

The method may further comprise the steps of placing (or arranging) the heat sink structure 10 in the housing 3, as shown in FIG. 5, and folding the second lid portion 12 such that it substantially closes the opening 14 of the heat sink structure 10 and clamps the light source portion 21 to the first lid portion 11, as shown in FIG. 6. The method may finally comprise mounting the envelope 2 to the housing 3 such that the envelope 2 encloses the light sources 5.

Optionally, the method may comprise a step of providing a reflective surface on the lid portions 11, 12, e.g. by finishing, or applying a reflecting film on, the outer surface of the lid portions 11, 12.

The person skilled in the art realizes that the present invention by no means is limited to the preferred embodiments described above. On the contrary, many modifications and variations are possible within the scope of the appended claims. For example, the lighting device 1 itself and/or the individual parts of the lighting device 1 may have different dimensions and/or sizes than those depicted/described. For example, the electronic carrier 20 may have a different shape, dimension and/or size, and the envelope 2 may have a standard bulb shape, or, substantially, any other shape, e.g. round, elongated or flat. Moreover, the number of parts, e.g. the number of lid portions 11, 12, the number of light sources 5, etc., may be different from that of depicted/described devices.

The invention claimed is:

1. A lighting device comprising:

a light source;

an electronic carrier comprising a first portion for carrying the light source and a second portion for providing an electrical connection to the light source; and a heat sink structure arranged for a dissipation of heat from the electronic carrier and defining a cavity, the heat sink structure comprising a first lid portion and a second lid portion arranged at an opening of the heat sink structure, wherein the first lid portion and the second lid portion form a lid over the cavity and substantially close the opening in a folded position;

wherein the first lid portion and the second lid portion in the folded position define a hole through which the electronic carrier extends, and the first portion of the electronic carrier is supported by the first lid portion outside the cavity, and the second portion of the electronic carrier is at least partially enclosed by the heat sink structure inside the cavity, and wherein the second lid portion partially overlaps the first lid portion and clamps the first portion of the electronic carrier to the first lid portion in the folded position, wherein the heat sink structure comprises a piece of sheet metal and wherein the piece of sheet metal comprises the first lid portion and the second lid portion arranged at an edge of the opening of the heat sink structure.

2. The lighting device as defined in claim 1 wherein the heat sink structure and the first and second lid portions are formed by a single piece of material.

3. The lighting device as defined in claim 2, wherein at least one of the first and second lid portions is fixed in a folded position by a locking means.

4. The lighting device as defined in claim 3, further comprising a housing at least partially enclosing the heat sink structure.

5. The lighting device as defined in claim 4, wherein the outer shape of the heat sink structure is at least partially conformed to the inner shape of the housing.

6. The lighting device as defined in claim 5, wherein the housing comprises an electrically insulating material.

7. The lighting device as defined in claim 6 wherein the first portion of the electronic carrier makes an angle of approximately 40° to 140° with the second portion of the electronic carrier.

8. The lighting device as defined in claim 7, wherein at least one of the first and second lid portions comprises a reflective surface adapted to reflect light from the light source.

9. A method of manufacturing a lighting device, the method comprising:

providing a heat sink structure defining a cavity and comprising a first lid portion and a second lid portion arranged at an opening of the heat sink structure and further comprising a piece of sheet metal;

folding the first lid portion such that it partially closes the opening;

arranging an electronic carrier comprising a first portion for carrying a light source and a second portion for providing an electrical connection to the light source, such that the electronic carrier extends through a hole defined by the first and second lid portion such that the first portion of the electronic carrier is supported by the first lid portion outside the cavity and the second portion of the electronic carrier is at least partially enclosed by the heat sink structure inside the cavity;

folding the second lid portion such that it together with the first lid portion forms a lid over the cavity and substantially close the opening of the heat sink structure and wherein the second lid portion partially overlaps the first lid portion and clamps the first portion of the electronic carrier to the first lid portion, and arranging the first lid portion and the second lid portion at an edge of the opening of the heat sink structure.

10. The lighting device as defined in claim 6, further comprising an envelope mounted to the housing and enclosing the light source.

11. The lighting device as defined in claim 8, wherein the heat sink structure is cup-shaped with another opening, which is opposite to the opening at which the first and second lid portions are arranged.

12. The lighting device as defined in claim 1, wherein the heat sink structure is formed by deep drawing a piece of sheet metal into a cup-like shape.

13. The lighting device as defined in claim 6 wherein the first portion of the electronic carrier makes an angle of approximately 60° to 120° with the second portion of the electronic carrier.

14. The lighting device as defined in claim 6 wherein the first portion of the electronic carrier makes an angle of approximately 80° to 100° with the second portion of the electronic carrier.

15. The method as defined in claim 9, further comprising the step of forming the heat sink structure and the first and second lid portions with a single piece of material.

16. The method as defined in claim 9, further comprising the step of forming the heat sink structure by deep drawing a piece of sheet metal into a cup-like shape.

17. A lighting device comprising:

a light source;

an electronic carrier comprising a first portion for carrying the light source and a second portion for providing an electrical connection to the light source; and a heat sink structure arranged for a dissipation of heat from the electronic carrier and defining a cavity, the heat sink structure comprising a first lid portion and a second lid portion arranged at an opening of the heat sink structure, wherein the first lid portion and the second lid portion form a lid over the cavity and substantially close the opening in a folded position, wherein the first lid portion and the second lid portion in the folded position define a hole through which the electronic carrier extends, and the first portion of the electronic carrier is supported by the first lid portion outside the cavity, and the second portion of the electronic carrier is at least partially enclosed by the heat sink structure inside the cavity, and wherein the second lid portion partially overlaps the first lid portion and clamps the first portion of the electronic carrier to the first lid portion in the folded position, wherein an edge of the first lid portion and an edge of the second lid portion align at an axis that runs along the diameter of the heat sink structure.

* * * * *